US007444289B2

(12) United States Patent
Oh et al.

(10) Patent No.: US 7,444,289 B2
(45) Date of Patent: Oct. 28, 2008

(54) AUDIO DECODING METHOD AND APPARATUS FOR RECONSTRUCTING HIGH FREQUENCY COMPONENTS WITH LESS COMPUTATION

(75) Inventors: Yoonhark Oh, Suwon (KR); Mathew Manu, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 897 days.

(21) Appl. No.: 10/652,189

(22) Filed: Sep. 2, 2003

(65) Prior Publication Data

US 2004/0107090 A1 Jun. 3, 2004

(30) Foreign Application Priority Data

Nov. 29, 2002 (KR) ..... 10-2002-0075529

(51) Int. Cl.
*G10L 19/00* (2006.01)
*G10L 19/14* (2006.01)
*G10L 13/00* (2006.01)

(52) U.S. Cl. ..... 704/500; 704/201; 704/205; 704/268

(58) Field of Classification Search ..... 704/201, 704/501; 370/437
See application file for complete search history.

(56) References Cited

U.S. PATENT DOCUMENTS 5,734,657 A * 3/1998 Kim ..... 370/437
5,812,971 A * 9/1998 Herre ..... 704/230
6,680,972 B1 * 1/2004 Liljeryd et al. ..... 375/240
2001/0044713 A1 * 11/2001 Lokhoff et al. ..... 704/201
2004/0078194 A1 * 4/2004 Liljeryd et al. ..... 704/200.1

FOREIGN PATENT DOCUMENTS

| | | | |
|---|---|---|---|
| JP | 56-39646 | A | 4/1981 |
| JP | 8-305396 | A | 11/1996 |
| JP | 11-284585 | A | 10/1999 |
| JP | 2000-59899 | A | 2/2000 |
| JP | 2001-521648 | A | 11/2001 |
| JP | 2002-132295 | A | 5/2002 |
| JP | 2002-168694 | A | 6/2002 |
| JP | 2002-182699 | A | 6/2002 |
| JP | 2002-244698 | A | 8/2002 |
| JP | 2002-247699 | A | 8/2002 |
| JP | 2004-046179 | A | 2/2004 |
| KR | 2002-0043617 | A | 6/2002 |
| KR | 10-2004-0007815 | A | 1/2004 |

* cited by examiner

*Primary Examiner*—David R. Hudspeth
*Assistant Examiner*—Josiah Hernandez
(74) *Attorney, Agent, or Firm*—Sughrue Mion, PLLC

(57) ABSTRACT

An audio decoding method and apparatus for reconstructing high frequency components with less computation are provided. The audio decoding apparatus includes a decoder, a channel similarity determination unit, a high frequency component generation unit, and an audio synthesizing unit. The audio decoding method generates high frequency components of frames while skipping every other frame for each channel signal; when right and left channel signals are similar to each other, generates high frequency components of the skipped frame for any one channel signal by using the generated high frequency components of the corresponding frame for the other channel signal; and when the right and left channel signals are not similar to each other, generates high frequency components of the skipped frames for each channel signal by using previous frames for the relevant channel signal.

12 Claims, 8 Drawing Sheets

Fig.
8
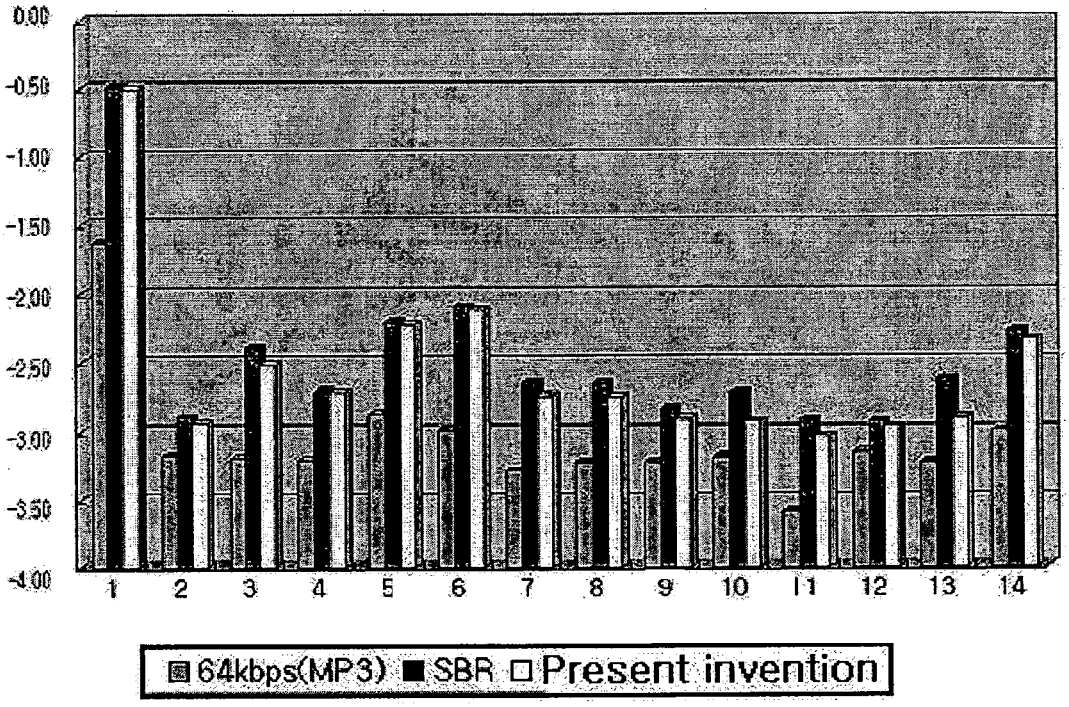

AUDIO DECODING METHOD AND APPARATUS FOR RECONSTRUCTING HIGH FREQUENCY COMPONENTS WITH LESS COMPUTATION

BACKGROUND OF THE INVENTION

1. Field of the Invention

The present invention relates to an audio decoding method and apparatus, and more particularly, to an audio decoding method and apparatus wherein high quality audio signals can be obtained and output by reconstructing high frequency components thereof with less computation. The present application is based on Korean Patent Application No. 2002-75529, which is incorporated herein by reference.

2. Description of the Related Art

In general, a psychoacoustic model is used to compress audio data more efficiently in audio coding such that fewer bits are allocated to high frequency components inaudible to the human ear. In such a case, the compression rate is increased, but high frequency audio signals are lost. Due to the loss of high frequency audio signals, when the audio data are reproduced, the sound tone is changed, readability is lowered, and subdued or dull sounds are generated. Thus, a post-processing method for reconstructing the lost high frequency components for sound quality enhancement is required so as to fully reproduce the tone of an original sound and increase the readability of the audio signals.

The post-processing method for enhancing the sound quality of audio signals is described in connection with FIG. 1. Referring to FIG. 1, if encoded signals are input, they are separated into right and left channel signals and the separated signals are decoded, respectively, through a decoder 110. Then, high frequency components for the decoded right and left channel signals are reconstructed by first and second high frequency component generator units 120, 130, respectively.

However, since the right and left channel audio signals of most audio signals are generally similar to and highly redundant with each other, they are not individually encoded. Therefore, there is a problem in that the conventional post-processing method for separately reconstructing the right and left channel signals cannot efficiently utilize similarities between channel signals, and thus, computation time is unnecessarily increased.

SUMMARY

An object of the present invention is to provide an audio decoding method and apparatus for allowing sound quality of audio signals to be enhanced even with less computation.

According to an aspect of the present invention for achieving the object, there is provided an audio decoding method, which comprises the steps of generating high frequency components of frames while skipping every other frame for each channel signal; when right and left channel signals are similar to each other, generating high frequency components of the skipped frame for any one channel signal by using the generated high frequency components of the corresponding frame for the other channel signal; and when the right and left channel signals are not similar to each other, generating high frequency components of the skipped frames for each channel signal by using previous frames for the relevant channel signal.

According to another aspect of the present invention, there is also provided an audio decoding apparatus for reconstructing high frequency components, which comprises an audio decoder for receiving encoded audio data, decoding the received data, and outputting decoded audio signals for first and second channels; a channel similarity determination unit for determining similarities between the first and second channel signals; a high frequency component generation unit for generating high frequency components of the audio signals for each channel based on the similarities between the first and second channel signals; and an audio synthesizing unit for combining the decoded audio signals with the generated high frequency components and outputting the combined audio signals.

BRIEF DESCRIPTION OF THE DRAWINGS

The above and other objects and features of the present invention will become apparent from the following description of preferred embodiments given in conjunction with the accompanying drawings, in which:

FIG. 8 is a graph in which audio quality enhancement by the audio decoding method according to the present invention is compared with the prior art.

DESCRIPTION OF THE PREFERRED EMBODIMENTS

Hereinafter, the configuration and operation of an audio decoding apparatus according to the present invention will be explained in detail with reference to the accompanying drawings.

Figure 1:
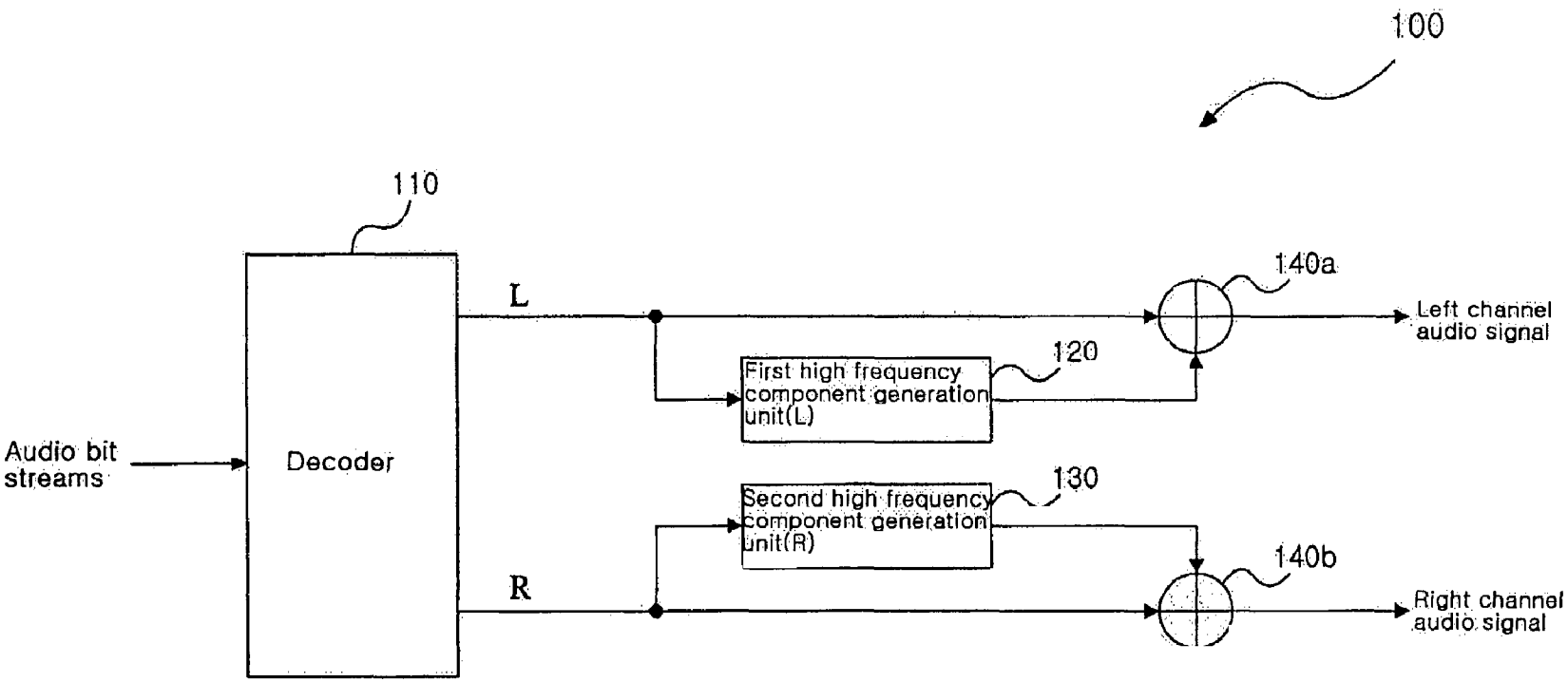
FIG. 1 is a block diagram showing an audio decoding apparatus to which a conventional post-processing algorithm is applied.
Figure 2:
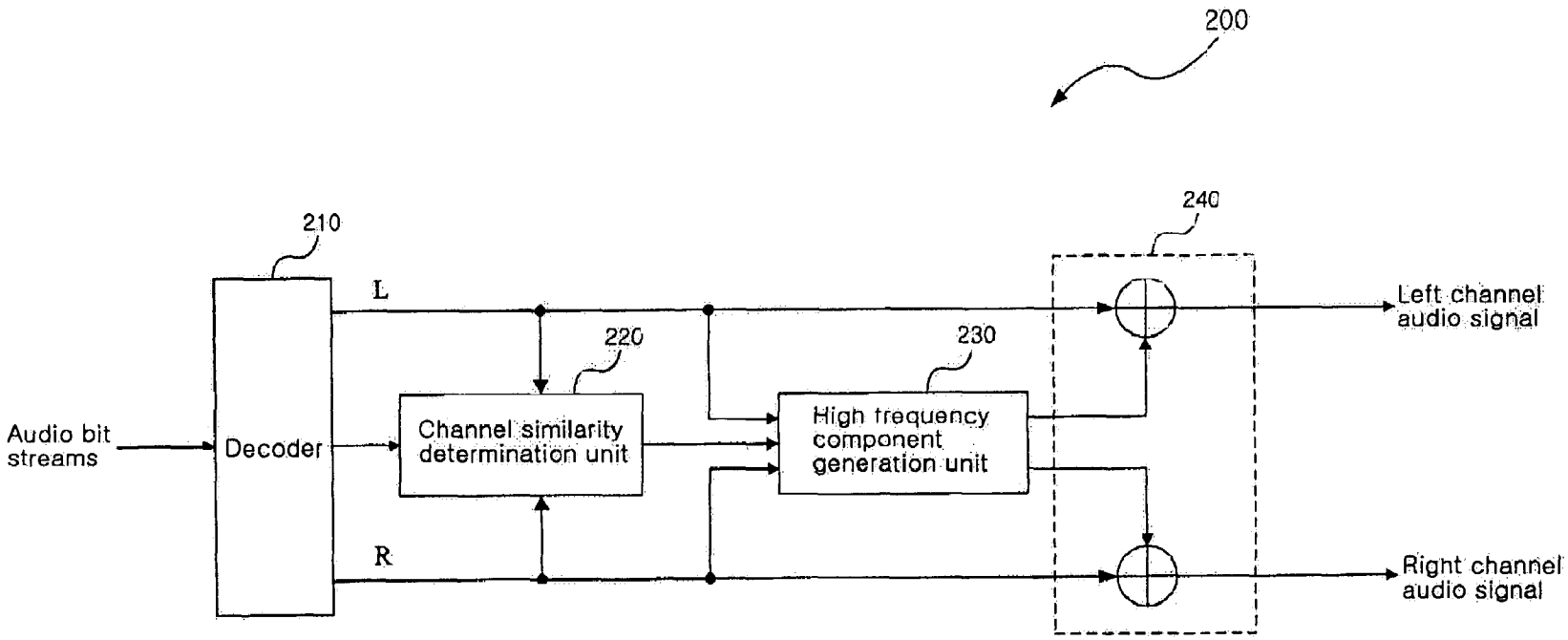
FIG. 2 is a diagram schematically illustrating the configuration of an audio decoding apparatus according to the present invention.

FIG. 2 is a diagram schematically showing the configuration of an audio decoding apparatus 200. Referring to FIG. 2, the audio decoding apparatus 200 comprises a decoder 210, a channel similarity determination unit 220, a high frequency component generation unit 230, and an audio synthesizing unit 240. The apparatus 200 is configured to decode audio bit streams and then to reconstruct high frequency components for respective channel signals from the decoded audio signals.

The decoder 210 decodes input audio bit steams and generates audio signals. That is, the audio data are decoded from the input audio bit streams, and the decoded data are then dequantized to restore quantization operations previously performed in the encoding process of the audio data, so that original audio signals are output.

Here, the decoding method employed in the decoder 210 can vary according to encoding type, such as scale factor coding, AC-3, MPEG and Huffman coding, used to compress audio signals. However, since the configurations and operations of the decoders used in audio signal processing are generally identical to one another, a detailed description thereof will be omitted.

Meanwhile, it is known that SBR (Spectral Band Replication), i.e., an algorithm for reconstructing a high frequency range from a low frequency range of audio signals, is the most efficient technique among several post-processing algorithms for sound quality enhancement that have been proposed so far. However, SBR2 cannot be applied to a variety of audio codecs, since it is a post-processing algorithm dependent on MPEG-1 layer 3. Further, SBR1 can be applied to a variety of audio codecs as compared with SBR2, but should perform the post-processing operations for both right and left channel signals every frame. Thus, the similarities between two channels cannot be effectively utilized for the operation, and consequently, computation time is increased. Therefore, there is a limitation in that this algorithm can hardly be applied to the relevant products.

Accordingly, in order to reduce the large computation corresponding to a problem of SBR1 (hereinafter, referred simply as to "SBR") that can be applied to a variety of audio codecs and have superior reconstruction performance, the present invention is configured such that channel similarities are effectively used through the channel similarity determination unit 220 and the high frequency component generation unit 230 so that the high frequency components can be reconstructed even with less computation.

When the decoded audio signals are input, the channel similarity determination unit 220 analyzes whether the input audio signals include mode information. Then, the channel similarity determination unit 220 determines the similarities between the right and left channel signals according to the mode information. Otherwise, it determines the similarities between the channel signals based on SNR (Signal to Noise Ratio) that has been obtained from information on sum of and difference between the channel signals.

Here, the reason that SNR is used to determine the similarities between the channel signals when the audio signals do not include mode information is that the similarities between the right and left channel can be easily determined based on the SNR value that has been obtained from the information on the sum of and difference between the channel signals, because the sum and difference information is frequently coded in general audio codecs when compression rate is high.

Hereinafter, a method for determining similarities between right and left channel signals will be described by way of example of MPEG-1 layer 3 audio signals for better understanding of the present invention.

Figure 3:
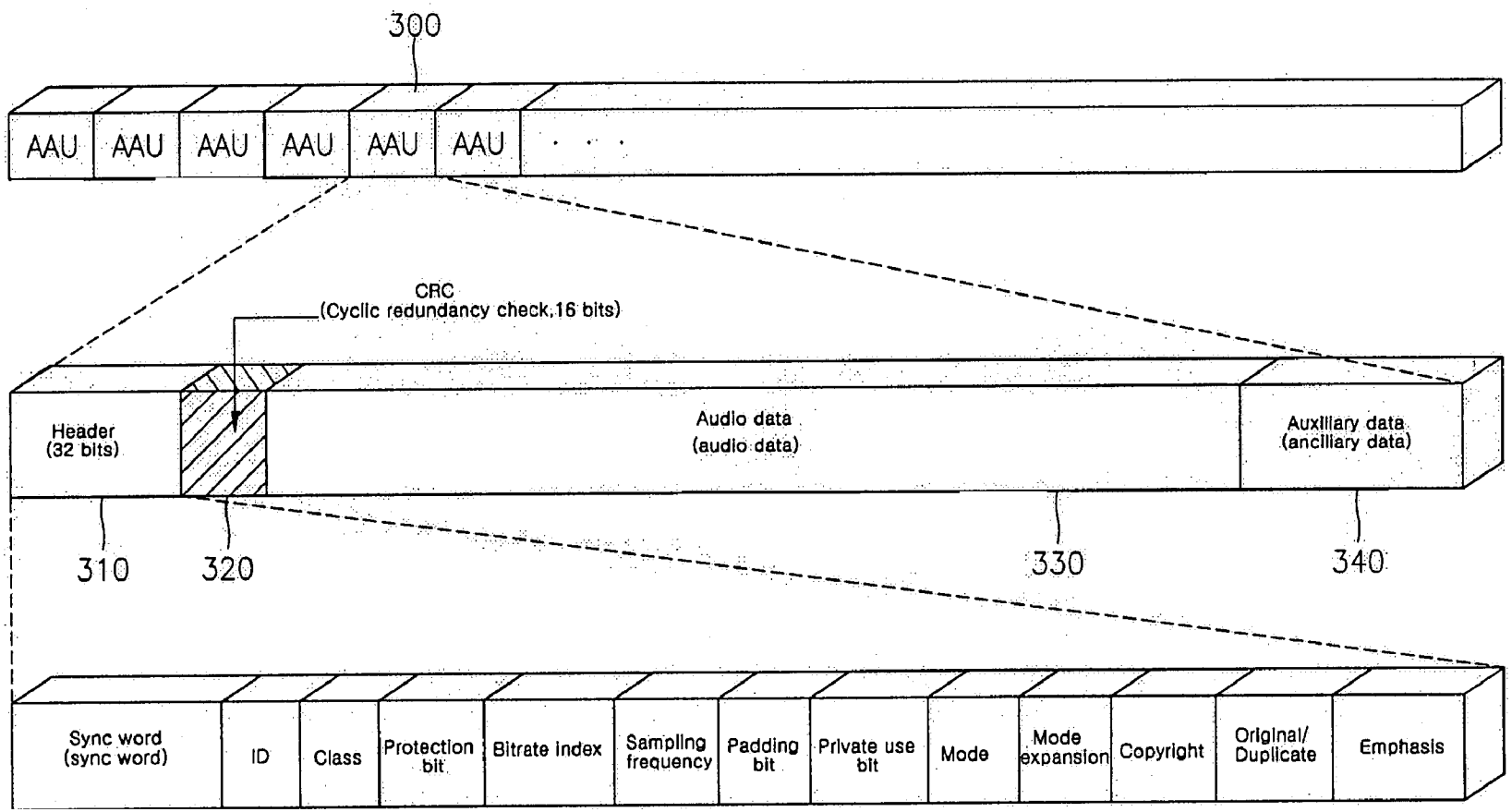
FIG. 3 is a diagram showing the format of MPEG-1 layer 3 audio streams.

FIG. 3 shows the format of MPEG-1 layer 3 audio streams.

MPEG-1 layer 3 audio streams are composed of a plurality of AAUs (Audio Access Units) 300. Each of the AAUs 300 is the smallest unit that can be individually decoded and contains a predetermined constant number of samples of compressed data.

Each of the AAUs 300 includes a header 310, a cyclic redundancy check (CRC) 320, audio data 330, and auxiliary data 340.

The header 310 contains information on sync word, ID, layer, presence of protection bit, bitrate index, sampling frequency, presence of padding bit, private use bit, mode, mode expansion, copyright, original/duplicate, and emphasis feature.

The CRC 320 is optional and 16 bits long, and the header 310 defines whether the CRC 320 is included in each of the AAUs 300.

The audio data 330 is the part in which compressed sound data are contained.

The auxiliary data 340 is the part remaining when an end of each audio data 330 does not reach the end of the relevant AAU. Any data other than MPEG audio data can be included in the auxiliary data 340.

As shown in FIG. 3, the header 310 of MP3 audio bit streams contains the mode information showing whether the streams have been compressed using similarities between channel signals. Thus, the similarities between the channel signals can be easily determined by analyzing the mode information of the input MP3 audio bit streams.

Therefore, when MPEG-1 layer 3 audio signals including the aforementioned mode information are input, the channel similarity determination unit 220 analyzes the mode information included in the input signal and determines the similarities between channel signals according to whether the mode information is either a joint stereo mode value having a great similarity between the right and left channel signals or a stereo mode value having a small similarity between the channel signals.

On the other hand, in a case where mode information is not included in the decoded audio signals, the channel similarity determination unit 220 calculates the SNR corresponding to a parameter for representing the similarities between channel signals on the basis of the information on the sum of and difference between the channel signals obtained from the audio signals. Then, if the calculated SNR value is smaller than a threshold of the similarity between channel signals, it is determined that the two channel signals are similar to each other. Otherwise, it is determined that the two channel signals are not similar to each other.

That is, the SNR value obtained from the information on the sum of and difference between the channel signals is used as the parameter for representing the similarities between channel signals. Now, a method for calculating the SNR value based on the information on the sum of and difference between the two channel signals will be described in detail.

First, energy values of the sum of and difference between the two channel signals are calculated. Then, the logarithm of a value obtained by dividing the energy value of the difference between the channel signals by an added value of the sum of and difference between the channel signals is taken. Thereafter, the logarithmic value is multiplied by 10. At this time, in order to reduce the computation needed for calculating energy values, it is preferable to use a magnitude of the sum of and difference between the two signals.

Here, an experimental value can be assigned to the threshold of the similarity between channel signals. In the present invention, a value of 20 dB has been determined as the threshold of the similarity between channel signals.

Therefore, the channel similarity determination unit 220 analyzes whether the audio signals include the mode information. If so, the determination unit determines the similarity between right and left channel signals based on the mode information. Otherwise, the determination unit determines the similarity based on the SNR obtained from the information on the sum of and difference between the two channel signals.

For reference, a variety of modifications or equivalents of the method for determining the similarities between right and left channel signals can be made by those skilled in the art. For example, if AC-3 audio signals are included in the information on the difference between right and left channel signals instead of the MPEG-1 layer 3 audio signals, the similarities between right and left channel signals can be determined. Further, if there are linear predictive coefficients in the audio bit streams, the similarities between right and left channel signals can be determined by decoding the linear prediction coefficients and modeling spectrum envelope signals.

Furthermore, the high frequency component generation unit 230 reconstructs the high frequency components for the right and left channel signals while skipping every other frame for each channel, using the SBR algorithm. Then, in a case where the right and left channel signals are similar to each other, the high frequency components generated in one channel are used for reconstructing high frequency components of the skipped frames for the other channel signal. In a case where the right and left channel signals are not similar to each other, the high frequency components of the previous frame for each channel signal are used for reconstructing the high frequency components of the skipped frames for the relevant channel signal. The details thereof will be described later with reference to FIGS. 5 and 7.

When the high frequency generation unit 230 reconstructs the high frequency components for each channel signal, the audio synthesizing unit 240 produces an output obtained by adding the generated high frequency components to the decoded audio signals. Accordingly, the high frequency components can be properly reconstructed depending on the similarities between channel signals, whereby unnecessary computation can be reduced and sound quality of audio signals can also be enhanced.

Hereinafter, an audio decoding method of the present invention will be explained in detail with reference to the accompanying drawings.

Figure 4:
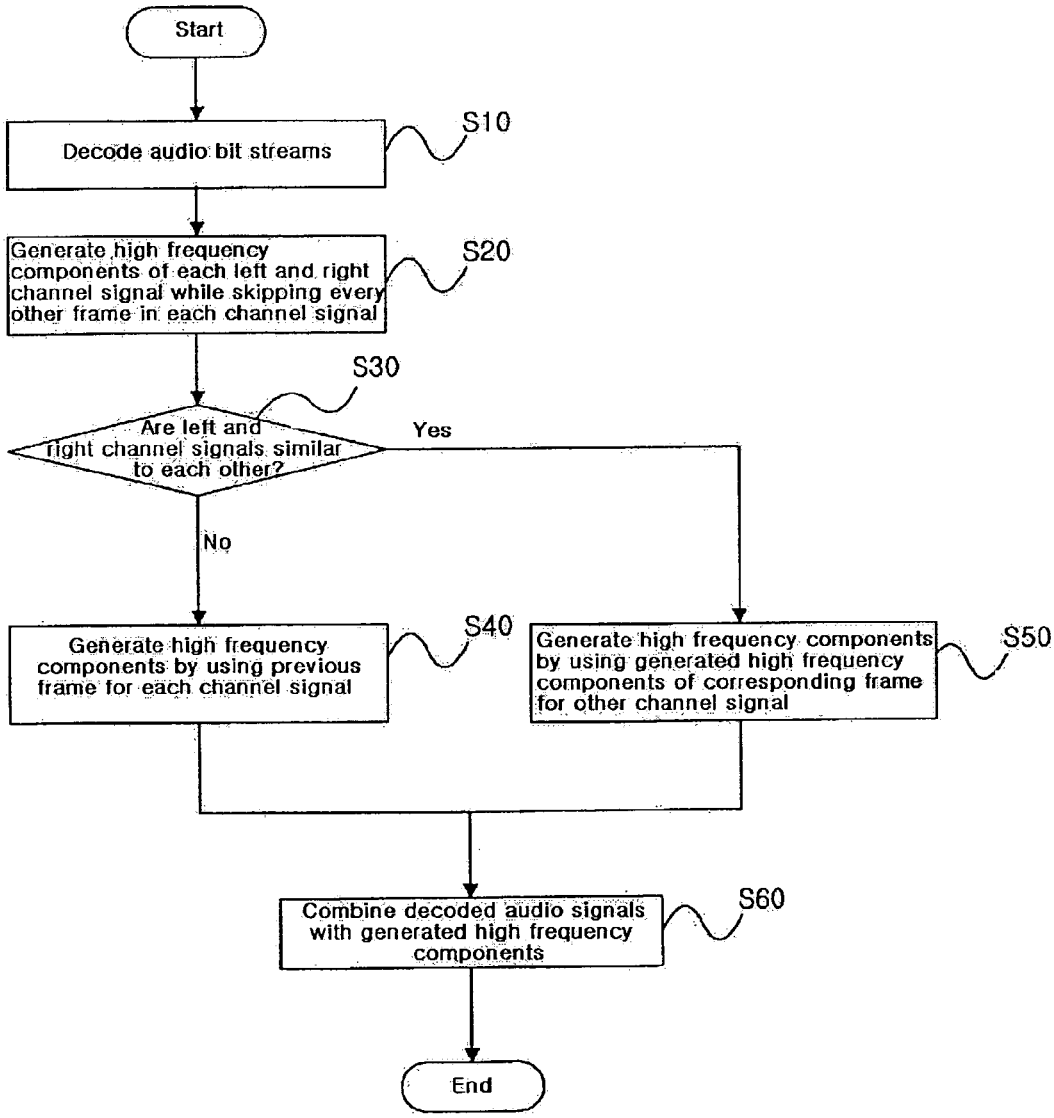
FIG. 4 is a flowchart illustrating the entire process of an audio decoding method according to the present invention.

FIG. 4 is a flowchart illustrating the entire process of the audio decoding method according to the present invention.

First, the decoder 210 decodes input audio bit streams and outputs audio signals (S10). Here, this decoding method can vary according to encoding types, such as AC-3, MPEG, and Huffman encoding, which are used to compress the audio signals.

Then, the high frequency component generation unit 230 reconstructs the high frequency components for the right and left channel signals while skipping every other frame for each channel signal, using the SBR algorithm (S20). The above will be described hereinafter more specifically with reference to FIG. 5.

Figure 5:
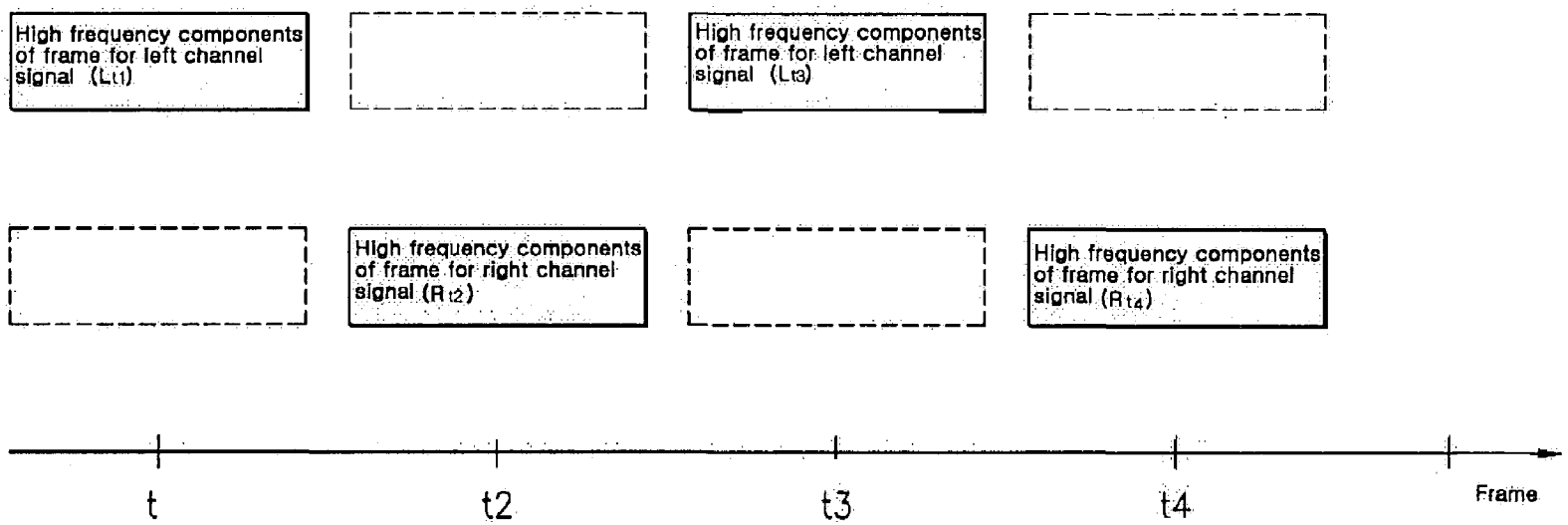
FIG. 5 is a diagram illustrating a process of generating high frequency components while skipping every other frame for each channel signal according to the present invention.

FIG. 5 is a diagram illustrating a process of generating high frequency components while skipping every other frame for each channel signal according to the present invention. Referring to FIG. 5, the high frequency generation unit 230 reconstructs the high frequency components while skipping every other frame for the right and left channel signals, respectively.

That is, the high frequency components for the left channel ($L_{t1}$) are generated from the frame at time $t_1$, while the high frequency components for the right channel ($R_{t2}$) are generated from the frame at time $t_2$. Similarly, this process is performed repeatedly at times $t_3$, $t_4$, $t_5$, and so on.

Then, the channel similarity determination unit 220 determines the similarities between right and left channel signals (S30). The method for determining the similarities between channel signals will be briefly described as follows.

First, the channel similarity determination unit 220 analyzes whether the decoded audio signals include mode information. If so, the determination unit 220 determines the similarities between channel signals based on the mode information, i.e., determines the similarities between channel signals according to whether the mode information is either a joint stereo mode value having a great similarity between right and left channel signals or a stereo mode value having a small similarity between the channel signals.

On the other hand, in a case where the mode information is not included in the decoded audio signals, the channel similarity determination unit 220 calculates the SNR corresponding to a parameter for representing the similarities between channel signals on the basis of the information on the sum of and difference between the channel signals obtained from the audio signals. Then, if the calculated SNR value is smaller than a threshold of the similarity between channel signals, it is determined that the two channel signals are similar to each other. Otherwise, it is determined that the two channel signals are not similar to each other. That is, if the mode information is not contained in the decoded audio signals, the SNR obtained from the information on the sum of and difference between the channel signals is regarded as a parameter for representing the similarities between channel signals and then compared with the threshold of 20 dB for determination of the similarities between channel signals.

The method for determining the similarities between channel signals depending on the mode information has already been described in connection with FIGS. 2 and 3, and thus, a detailed description thereof will be omitted.

Further, in a case where the channel similarity determination unit 220 determines that the right and left channel signals are not similar to each other, the high frequency component generation unit 230 reconstructs the high frequency components of the skipped frames by using the high frequency components of the previous frames for each channel signal, thereby generating the high frequency components of the respective channel signals (S40). This process will be described more in detail with reference to FIG. 7.

Figure 7:
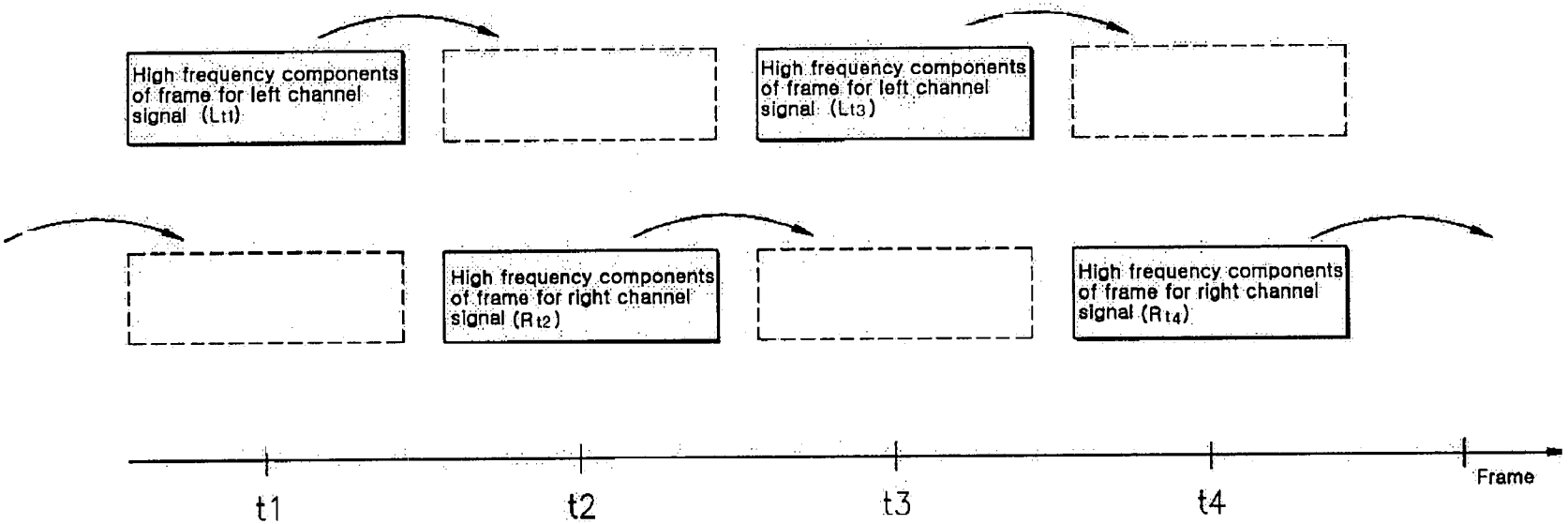
FIG. 7 is a diagram illustrating a method for generating high frequency components for the right and left channel signals when the channel signals are not similar to each other.

FIG. 7 is a diagram illustrating a method for generating high frequency components for right and left channel signals when the two channel signals are not similar to each other. Referring to FIG. 7 when the right and left channel signals are not similar to each other, the high frequency component generation unit 230 reconstructs the high frequency components of the skipped frames by using the generated high frequency components of the previous frame (the high frequency components generated while skipping every other frame) for each channel signal.

In other words, the high frequency components $L_{t1}$ of the left channel signal at time $t_1$ are substituted for the high frequency components of the skipped frame, i.e., the high frequency components $L_{t2}$ of the left channel at time $t_2$. Similarly, the high frequency components $R_{t2}$ of the right channel signal at time $t_2$ substitute for the high frequency components $R_{t3}$ at time $t_3$.

On the other hand, in a case where the channel similarity determination unit 220 determines that the right and left channel signals are similar to each other, the high frequency component generation unit 230 utilizes the high frequency components generated from one channel signal so as to reconstruct the high frequency components for the other channel signal (S50). This process will be now described more in detail with reference to FIG. 6.

Figure 6:
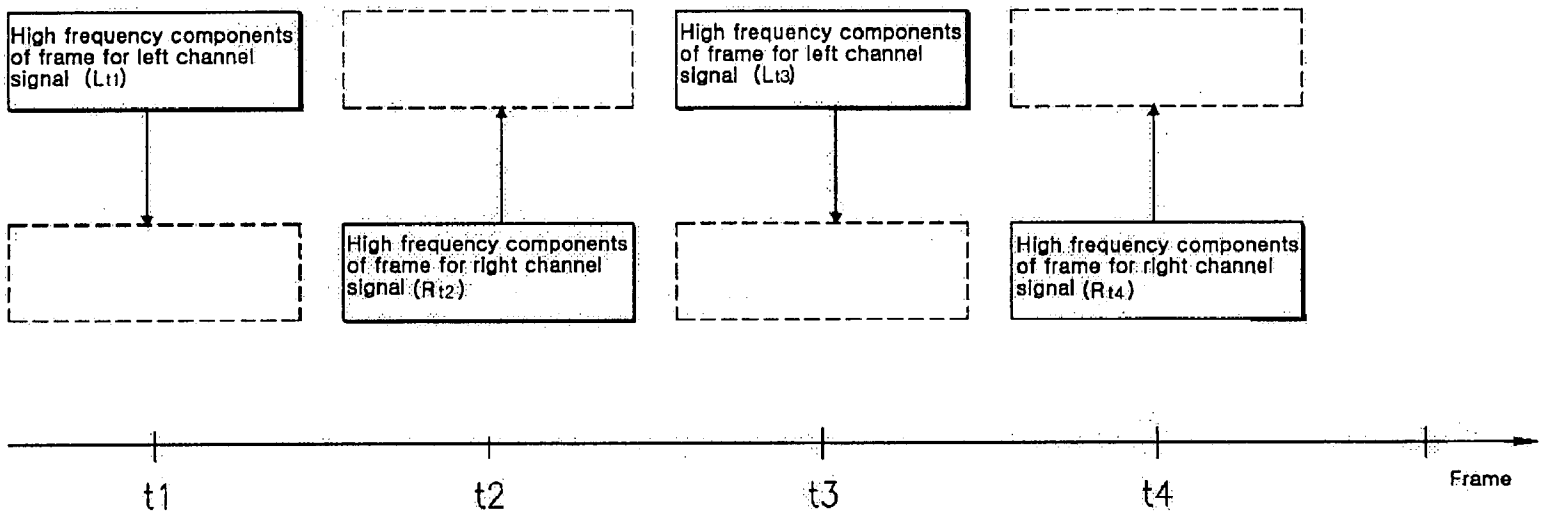
FIG. 6 is a diagram illustrating a method for generating high frequency components for right and left channel signals when the channel signals are similar to each other.

FIG. 6 is a diagram illustrating a method for reconstructing the high frequency components for each channel signal when the left channel and right channel signals are similar to each other. Referring to FIG. 6, when it is determined that right and left channels are similar to each other, the high frequency component generation unit 230 causes the high frequency components for the left channel signals to be substituted for those of the skipped frames for the right and left channel signals, respectively. At this time, the high frequency components generated from each channel signal can be multiplied by a predetermined modification value (e.g., a specific constant) and be used for the generation of the high frequency components from the other channel signal.

That is, the high frequency components for the left channel signal ($L_{t1}$) are substituted for the corresponding high frequency components for the right channel signal ($R_{t1}$) at time $t_1$, and the high frequency components for the right channel signal ($R_{t2}$) are substituted for the corresponding high frequency components of the left channel ($L_{t2}$) at time $t_2$.

At this time, since the right and left channel signals are generally very similar to each other, the deterioration of sound quality is minimized. Further, the high frequency components are generated while skipping every other frame for each channel signal, and efficiently used as those of the other channel signal. Thus, computation can be reduced by about 30% as compared with the conventional SBR algorithm.

Finally, the generated high frequency components are combined with the decoded audio signals, and the combined signals are then output (S60).

In general, since the right and left channel signals of most audio signals are similar to each other, the decoding of audio bit streams according to the decoding method of the present invention allows the computation needed for reconstructing the high frequency components to be reduced by approximately 30% as compared with the prior art.

FIG. 8 shows an example in which sound quality enhancement of the present invention is compared with that of the conventional SBR and MP3 methods. The experiments have been performed 14 times for evaluating the sound quality of the audio signals of a variety of songs, including 3 jazz, 9 pop, 7 rock, 6 classical pieces, which are compressed at a rate of 64 kbps. An opera tool, which is a well-known system for measuring compressed digital voice/audio signals, has been used as a sound quality evaluation program. It is also determined that the reconstructed sound quality improves as the value measured by the opera tool approaches zero.

As shown in FIG. 8, it can be understood that the sound quality of the audio signals reproduced by the method of reconstructing the high frequency components according to the present invention is almost the same as or negligibly different from that of the conventional SBR and MP3 methods.

Therefore, contrary to the conventional SBR algorithm that is difficult to apply practically to relevant products due to excessive computation time in spite of good sound quality enhancement, the present invention allows high quality audio signals to be output even while reducing the computation by approximately 30%.

Furthermore, the preferred embodiments of the present invention can be implemented in the form of programs executable by a computer. Further, the programs can be run on digital computers through a computer-readable recording medium.

The computer-readable recording medium includes a magnetic recording medium (e.g., ROM, floppy disk, hard disk, etc.) and an optical reading medium (e.g., CD ROM, DVD, etc.).

According to the present invention constructed as such, a critical problem in that it is hard to apply conventional post-processing algorithms to relevant products due to excessive computation time, in spite of the resulting sound quality enhancement, can be solved. Therefore, there is an advantage in that the computation time needed for the reconstruction of high frequency components can be significantly reduced by approximately 30%.

Although the present invention has been described in connection with the preferred embodiments shown in the drawings. It will be apparent to those skilled in the art that various changes and modifications can be made thereto without departing from the scope and spirit of the present invention. Therefore, the preferred embodiments of the present invention should be considered as not restrictive but illustrative. Further, the true scope of the present invention is defined by the appended claims, and changes and modifications should be construed as falling within the scope of the present invention.

What is claimed is:

1. A method for generating high frequency components when decoding audio data, comprising:

generating the high frequency components by utilizing similarities between first and second channel signals, wherein the method further comprises the steps of, when the first and second channel signals are similar to each other, generating high frequency components of only some frames for each channel signal; and generating high frequency components of other frames for each channel signal by using the generated high frequency components of the some frames for an other channel signal.

2. The method claimed in claim 1, wherein the high frequency components of the other frames are generated by properly modifying the high frequency components of the some frames.

3. A method for generating high frequency components when decoding audio data, comprising:

generating the high frequency components by utilizing similarities between first and second channel signals, wherein the method further comprises the steps of, when the first and second channel signals are not similar to each other, generating high frequency components of only some frames for each channel signal; and generating high frequency components of the other frames for each channel signal by using the generated high frequency components of the some frames for a relevant channel signal.

4. The method as claimed in claim 3, wherein the high frequency components of the other frames are generated by properly modifying the high frequency components of the some frames.

5. An audio decoding method for reconstructing high frequency components, comprising the steps of:

(a) receiving encoded audio data, decoding the received data, and outputting decoded audio signals for first and second channels;

(b) generating the high frequency components of only some frames for each of the first and second channel signals;

(c) determining similarities between the first and second channel signals;

(d) when the first and second channel signals are similar to each other, generating high frequency components of the other frames for each channel signal by using the generated high frequency components of the some frames for an other channel signal; and (e) combining the generated high frequency components with the decoded audio signals and outputting the combined audio signals.

6. The method as claimed in claim 5, wherein step (c) comprises the step of determining the similarities between channel signals based on a signal-to-noise ratio (SNR) that has been obtained from information on a sum of and a difference between the first and second channel signals.

7. The method as claimed in claim 5, wherein the audio data include mode information.

8. The method as claimed in claim 5, wherein step (c) comprises the step of determining whether the mode information is a joint stereo value that represents a great similarity between the first and second channel signals or a stereo mode value representing no similarity between the first and second channel signals.

9. The method as claimed in claim 5, further comprising the step of, when it is determined that the first and second channel signals are not similar to each other, generating high frequency components of the other frames for each channel signal by using the generated high frequency components of the some frames for a relevant channel signal.

10. An audio decoding apparatus for reconstructing high frequency components, comprising:

an audio decoder for receiving encoded audio data, decoding the received data, and outputting decoded audio signals for first and second channels;

a channel similarity determination unit for determining similarities between the first and second channel signals;

a high frequency component generation unit for generating high frequency components of the audio signals for each channel based on the similarities between the first and second channel signals; and an audio synthesizing unit for combining the decoded audio signals with the generated high frequency components and outputting the combined audio signals, wherein the high frequency component generation unit is configured by generating the high frequency components of only some frames for each of the first and second channel signals and then generating high frequency components of other frames for each channel signal by using the generated high frequency components of the some frames for an other channel signal when the first and second channel signals are similar to each other.

11. An audio decoding apparatus for reconstructing high frequency components, comprising:

an audio decoder for receiving encoded audio data, decoding the received data, and outputting decoded audio signals for first and second channels;

a channel similarity determination unit for determining similarities between the first and second channel signals;

a high frequency component generation unit for generating high frequency components of the audio signals for each channel based on the similarities between the first and second channel signals; and an audio synthesizing unit for combining the decoded audio signals with the generated high frequency components and outputting the combined audio signals, wherein the high frequency component generation unit is configured by generating high frequency components of only some frames for each channel and then generating high frequency components of the other frames for each channel signal by using the generated high frequency components of the some frames for the relevant channel signal when the first and second channel signals are not similar to each other.

12. A computer-readable recording medium in which a program for executing a method of any one of claims 1 to 9 in a computer is recorded.

* * * * *